US005097888A

United States Patent [19]

Augustine, III

[11] Patent Number: 5,097,888

[45] Date of Patent: Mar. 24, 1992

[54] CASTING FLOW CONTROL SYSTEM

[76] Inventor: Robert B. Augustine, III, 1604 Claremont Ave., Richmond, Va. 23227

[21] Appl. No.: 583,547

[22] Filed: Sep. 17, 1990

[51] Int. Cl.[5] ..... B22D 11/10

[52] U.S. Cl. ..... 164/483; 164/420; 164/483

[58] Field of Search ..... 164/483, 488, 420, 437

[56] References Cited

U.S. PATENT DOCUMENTS

| | | | |
|---|---|---|---|
| 2,218,171 | 10/1940 | Junghans | 164/420 |
| 3,494,410 | 2/1970 | Birchill et al. | 164/420 |
| 3,619,866 | 11/1971 | Hofmann et al. | 164/498 |
| 4,549,600 | 10/1985 | Kauserud | 164/323 |
| 4,694,887 | 9/1987 | Matsui et al. | 164/428 |
| 4,714,102 | 12/1987 | Koya | 164/457 |
| 4,730,660 | 3/1988 | Tinnes et al. | 164/420 |
| 4,744,407 | 5/1988 | Fishman et al. | 164/457 |
| 4,865,115 | 9/1989 | Hirata et al. | 164/428 |
| 4,883,113 | 11/1989 | Matsui et al. | 164/428 |

FOREIGN PATENT DOCUMENTS

| | | | |
|---|---|---|---|
| 969019 | 4/1958 | Fed. Rep. of Germany | 164/420 |
| 3425081 | 1/1986 | Fed. Rep. of Germany | 164/420 |

*Primary Examiner*—Richard K. Seidel

*Attorney, Agent, or Firm*—Alan M. Biddison

[57] ABSTRACT

Molten metal supply trough extends over station for continuously casting ingots, and has side channels each conducting the metal to a spout supplying an ingot. Simultaneously liftable gates control flow into the respective side channels.

5 Claims, 3 Drawing Sheets

CASTING FLOW CONTROL SYSTEM

FIELD OF THE INVENTION

Casting of metal ingots is the general field of the invention.

BACKGROUND OF THE INVENTION

In the aluminum industry, large rolling ingots are produced by conducting molten metal from a furnace to a casting station, in which two or more ingots are formed by spraying coolant directly against the sides of each ingot while feeding molten metal to the top. The level of the top of the ingot remains substantially constant as the ingot is slowly lowered. A trough extends across the tops of each in-line group of ingots being cast, and from each trough a plurality of spouts (e.g., two to six or more for large rolling ingots) extend down to supply molten metal from each spout to the top of an ingot. Flow through each spout is controlled by a pin to plug the opening from the trough into the spout. Each pin extends up through the molten metal in the trough and is operated by a stem connected to the top of the pin. Each stem is connected to means for raising or lowering the stem and the pin attached to it. A gate upstream of all the spout openings controls flow into the trough from the furnace. A single platen supports all of the starting blocks of the ingots supplied by the trough, so that all of the ingots drop at the same time and rate.

When starting up a casting operation, all of the pins beneath the trough are raised enough to provide full flow, or a predetermined partially restricted flow, into the spouts, and then the upstream gate is fully opened. As soon as an of the ingots has received enough metal to start the drop, the platen starts down and the drop begins for all of the ingots beneath the trough.

This system of starting a direct chill casting drop has long been in general use when casting through mold rings which are in contact with the perimeter of each ingot. However, when electromagnetic force (EMF) is substituted for mold contact, the start-up conditions are more critical and the proportion of ingots which crack during start-up increases undesirably. The presence of the control pins causes turbulence in the stream of molten metal flowing through the trough during start-up. The amount of such turbulence varies among the different openings from the trough into the spouts, and the net result is that flow to the spouts is not evenly distributed during start-up, when using the conventional system described above.

SUMMARY OF THE INVENTION

In accordance with the invention, the flow of metal to a casting station beneath a trough is improved by interposing a gate or the like between the entry into each spout to an ingot and the main body of molten metal in the trough, to control flow from the trough into the adjacent spout entry, and by providing means to open all of said additional gates simultaneously after the trough has initially been filled with molten metal. Also in accordance with the invention, the openings into the spouts are displaced from the main path of the trough, and each opening is provided with a separate side channel connecting it to the main path of the trough. This removes the pins from the main path of the trough, where their effect on turbulence is greatest, and also facilitates emplacement of a separate control gate for each spout entry.

The invention is particularly useful in connection with casting stations where the forming ingot is restrained only by electromagnetic force, but is also useful where mold rings are in contact with the metal being cast.

Other objects, advantages and details of the invention will become apparent as the following disclosure proceeds.

DRAWINGS ILLUSTRATING THE INVENTION

The present preferred embodiment of the invention is shown in the following drawings, in which.

DETAILED DESCRIPTION OF PRESENT PREFERRED EMBODIMENT

Figure 1:
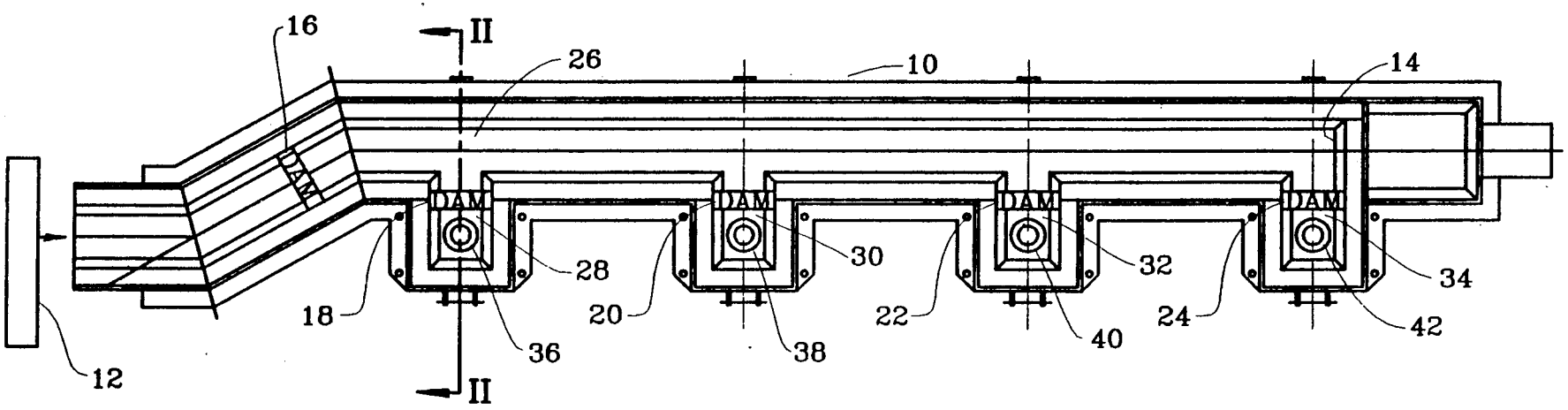
FIG. 1 shows a top plan view of a trough of a casting station in accordance with the invention.

Referring now more particularly to the drawings, there is shown a trough 10 connected to receive molten metal from a furnace 12 at one end of the trough. The other end of the trough is closed by an end wall 14. The inlet end of the trough is closed by a removable dam 16. Removable dams 18, 20, 22 and 24 control entry of molten metal from the main channel 26 of trough 10 into side channels 28, 30, 32 and 34 from the main channel 26. Openings through the bottoms of side channels 28, 30, 32 and 34 provide entries into downspouts 36, 38, 40 and 42 which supply ingots 44.

Each downspout (e.g., downspout 36 in FIG. 2) has its lower end positioned to supply molten metal into the pool of molten metal at the top of one of the ingots 44 being formed during a casting operation. Each ingot has a rectangular cross-section, with its longer side extending normal to the length of trough 10, so that several large ingots can be conveniently cast side by side under the trough. A rectangular skim dam 46 may extend around each spout, and an electrical coil 48 extends in a rectangle around and slightly spaced from the outer periphery of the ingot, to supply electromagnetic force to control outward flow of molten metal from the top of top ingot. Spray means 49 (shown diagrammatical) direct coolant against the sides of each ingot.

Figure 2:
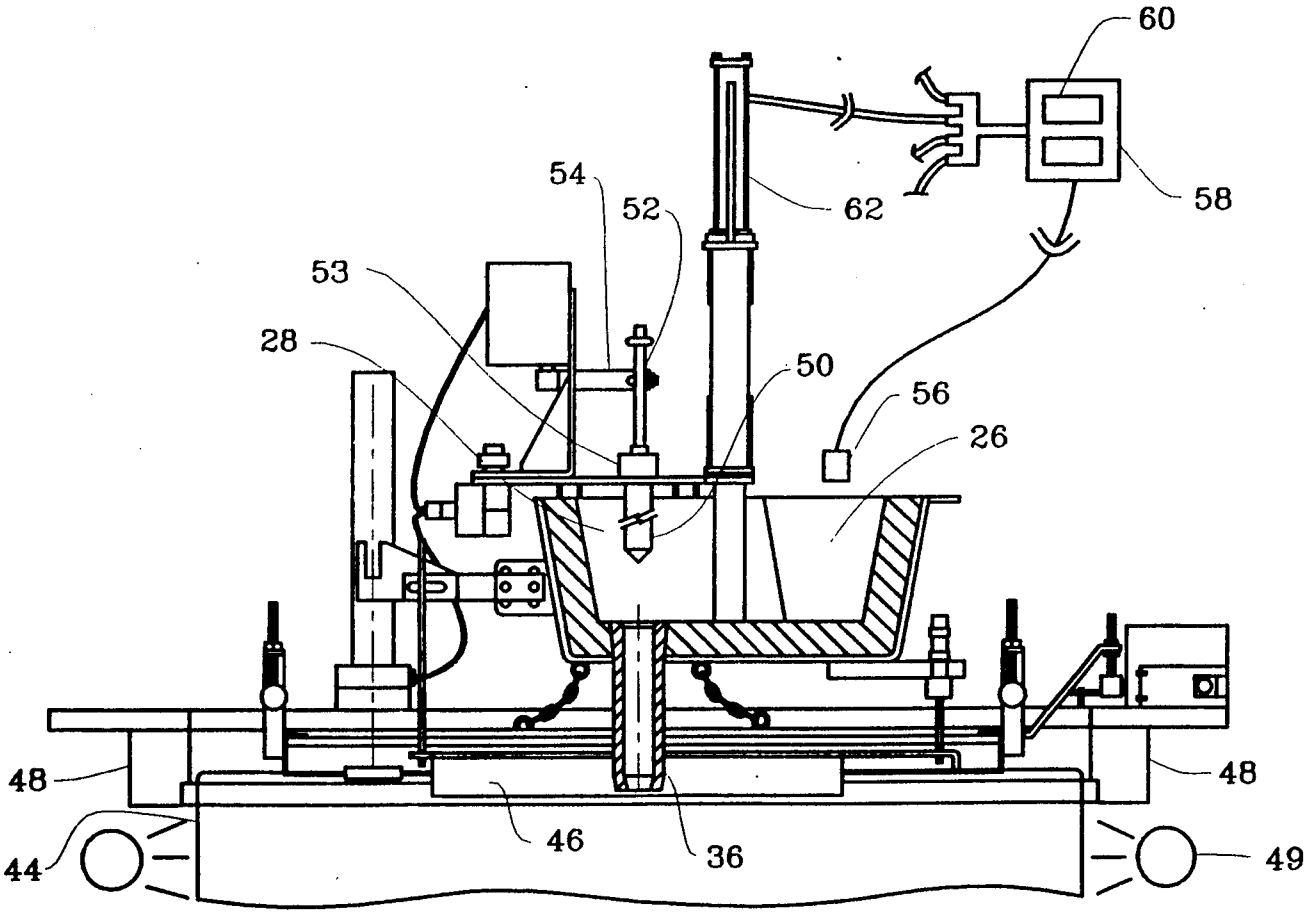
FIG. 2 shows an enlarged section on the line II—II in FIG. 1, and adjacent elements of said casting station.
Figure 3:
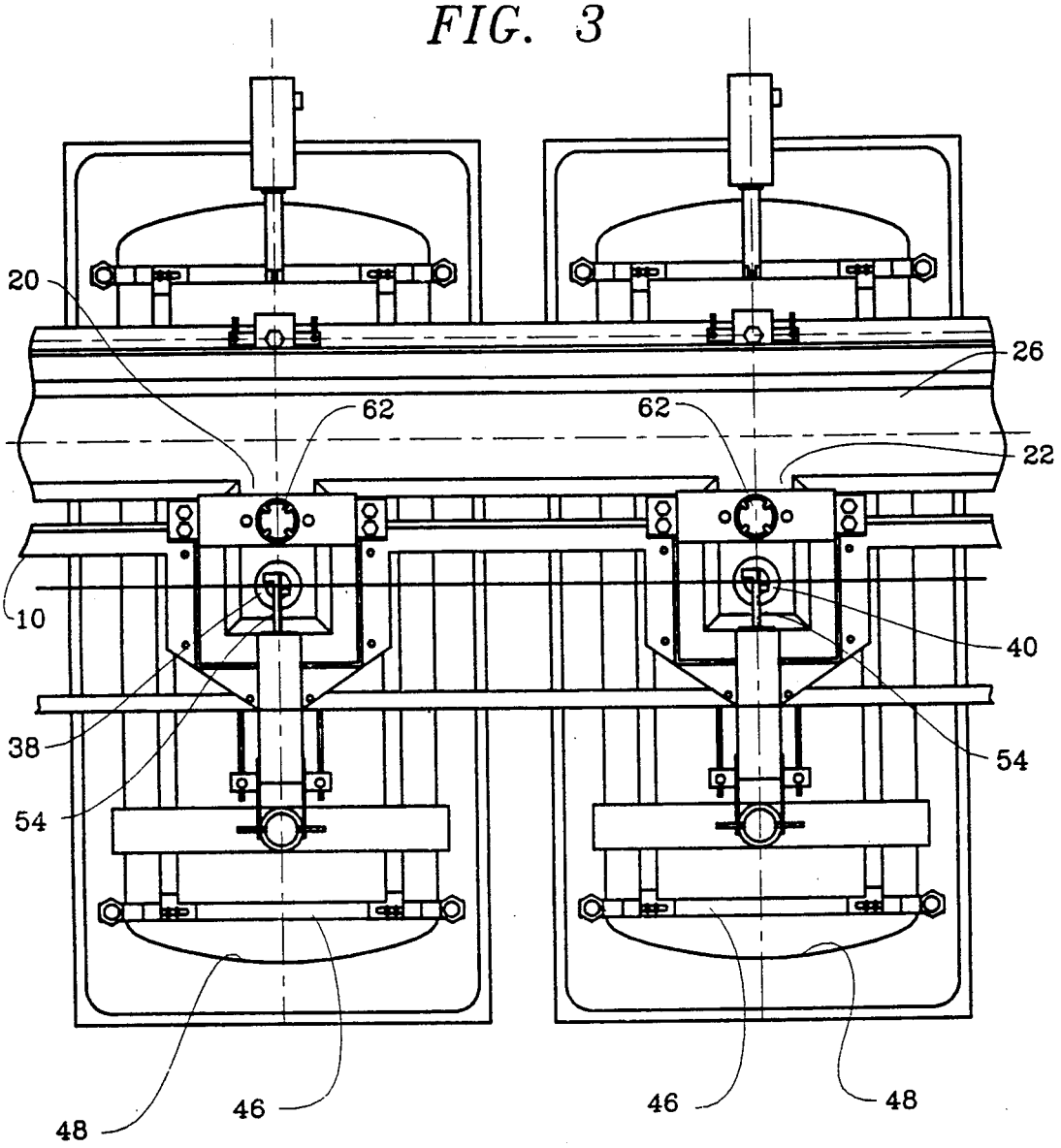
FIG. 3 shows a top plan view, partially broken away, of said casting station.
Figure 4:
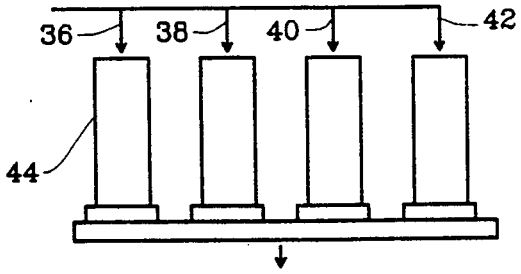
FIG. 4 shows diagrammatically ingots in said casting station being simultaneously lowered while supplied with molten metal.

Pins 50 (FIG. 2) are used conventionally to plug the bottoms of the spouts when a drop has been completed. Each of the pins 50 is controlled by a stem 52 connected to pin 50 by a collar 53. Each stem 52 is raised or lowered, together with the attached pin 50, by conventional operation of an arm 54. Before initiating a drop, the pins 50 are adjusted relative to the bottom of the spouts to provide full flow or less than full flow (about 80% to 100%) through each of the spouts. FIG. 2 shows pin 50 broken away, with its lower end out of spout 36, but in practice the lower end of each pin is in the spout, and is normally raised initially less than an inch above its lowermost position in the spout.

A float or non-contact sensor 56 (FIG. 2) is mounted near the top level of molten metal in the main channel 26 to detect when the main channel is full of molten metal. Sensor 56 is connected to signal a control 58 to open a solenoid valve 60 when molten metal rises to its full level in the main channel 26. Solenoid 60 controls outflow of compressed gas (such as dry nitrogen) to air lines connected to air cylinders 62 for simultaneously raising all of the dams 18, 20, 22 and 24. The main gate 16 is conventionally installed, with a float to actuate means for raising the main gate when the level of molten metal behind it from the furnace has reached a predetermined level.

When a new drop is to be started, pins 50 are prepositioned in their predetermined open position. After start-up, they may be conventionally adjusted and finally closed when the drop is completed. Dams 18, 20, 22 and 24 are all in their closed positions, and no molten metal is in the system downstream of the main dam 16.

To start the operation, molten metal is drawn from furnace 12 until it reaches the level where the main dam 16 opens, and trough 10 fills to the level detected by sensor 56 to actuate solenoid valve 60 and thereby simultaneously lift all of the gates 18, 20, 22 and 24. The spouts 36, 38, 40 and 42 then begin receiving molten metal substantially simultaneously and at the same rate. This fills the starter blocks for the ingots 44, and conventional sensing and operating means then start a downward movement of all of the ingots 44. Since the timing of this downward movement is the same for all of the ingots, and all of the ingots begin filling at substantially the same time and rate, the conditions are substantially the same in all of the ingots during the critical starting period. The result is to minimize a percentage of bad ingots cast during each drop, not only when casting with conventional contact ring molds, but also when casting with the more critical electromagnetic molds.

While the invention was originated for purposes of casting large rolling ingots of aluminum alloys for can body or lid stock, it is also applicable to ingots of other shapes and alloys, and also to other metals than aluminum alloys.

While present preferred embodiments of the invention have been illustrated and described, it will be understood that the invention may be otherwise variously embodied and practiced within the scope of the following claims.

I claim:

1. Metal casting apparatus, comprising means forming an elongated trough to receive molten metal, a plurality of annular molds adapted to progressively receive molten metal and progressively cast it into ingots which progressively emerge beneath the molds during casting, means for supporting and simultaneously lowering ingots emerging beneath the molds, a separate channel extending from the trough for supplying molten metal to each mold, means for controlling flow of molten metal from the trough into each channel, said flow control means for each channel having an open position permitting flow of molten metal to the channel and a closed position preventing flow to the channel, and means for moving the respective channel flow control means to open positions simultaneously, whereby the flow control means for the channels may be in closed positions to permit molten metal to accumulate in the trough preliminary to casting, and, when ready for casting, flow of molten metal may be started simultaneously into the channels thereby facilitating simultaneous start-up of casting in the molds.

2. Apparatus according to claim 1, in which each mold is adapted to be in contact with an ingot being cast through the mold.

3. Apparatus according to claim 1, in which each mold comprises an electrical coil for inducing electromagnetic force.

4. Metal casting apparatus according to claim 1, in which said channels extend from the sides of the trough, and the outer end of each channel overlies one of the molds.

5. A method of casting metal, comprising providing an elongated trough for supplying molten metal to a plurality of molds beneath the trough for progressively forming an ingot through each mold as metal is fed to it while lowering the forming ingot, and starting the casting operation by preventing outflow of molten metal from the trough until it is full and subsequently permitting outflow of molten metal from the trough simultaneous into side channels from the trough and thence to the molds.

* * * * *